United States Patent [19]

Meeker

[11] 4,240,625

[45] Dec. 23, 1980

[54] RECLINING CHAIR

[75] Inventor: Paul K. Meeker, Kent, Ohio

[73] Assignee: Century Products, Inc., Cleveland, Ohio

[21] Appl. No.: 961,382

[22] Filed: Nov. 16, 1978

[51] Int. Cl.[3] ..... A63G 9/16; A47C 1/02

[52] U.S. Cl. ..... 272/86; 297/276; 297/329

[58] Field of Search ..... 272/85, 86; 297/276, 297/278, 302, 303, 325–329; 248/188.2, 351, 370, 371

[56] References Cited

U.S. PATENT DOCUMENTS

| | | | |
|---|---|---|---|
| 2,232,985 | 2/1941 | Weaver | 297/325 X |
| 3,370,885 | 2/1968 | Gale | 297/329 |

*Primary Examiner*—Anton O. Oechsle

[57] ABSTRACT

A reclining chair having a seat, and a support structure including an element which supports the bottom of the seat. The attitude of the seat is shiftable relative to the support structure between an upright and a reclining position by a pivotable interconnect between the bottom of the seat and the element which supports the bottom of the seat.

9 Claims, 4 Drawing Figures

RECLINING CHAIR

BRIEF SUMMARY OF THE INVENTION

This invention relates to a reclining chair. The invention is particularly applicable to reclining chairs for infants which are adapted to be suspended from above for swinging movement, and will be described in connection with this application. It will be appreciated, however, that the invention has wider utility and may be incorporated in other kinds of chair applications.

Exemplary of swinging chairs to which the present invention may be applied are those described in U.S. Pat. Nos. 3,526,400 and 3,794,317. In general, these swinging chairs comprise a seat, a frame structure, a header in which is mounted a spring motor capable of producing oscillatory motion, and means for suspending the seat from the header in such fashion that the oscillatory motion generated by the spring motor is imparted to the seat.

In the swings illustrated and described in these patents, and in other commercially available swings with which the inventor is acquainted, the seat is formed of a fabric or other soft material supported on a metal frame, which in turn is suspended from the header by chains, rods or combinations of them. In these prior art devices, no adjustment is provided in the attitude of the seat nor, because of the soft flexible nature of the seat is it feasible to support the seat from its bottom.

Other prior art known to the inventor which is relevant to but not anticipatory of the present invention is the recliner described in U.S. Pat. No. 4,032,099.

The reclining chair structure of the present invention provides a seat structure having at least a rigid bottom which makes the entire seat assembly supportable from the seat bottom, and means for adjusting the attitude of the seat between an upright position and a reclining position. This allows an infant to be comfortably postured both when it is awake and alert, and when it is relaxed and asleep. In addition, the reclining chair structure of the present invention permits a simplification of the supporting mechanism by requiring only two points of suspension. This is in contrast to prior art arrangements such as those illustrated in U.S. Pat. Nos. 3,526,400 and 3,794,317 which generally require a four point suspension system. The adjustment in attitude of the seat in accordance with the present invention is accomplished by providing means for pivoting the seat with respect to structure which supports the seat.

Thus, in accordance with one aspect of the invention, there is provided a reclining chair comprising a molded seat having an integral back, sides and bottom, support means for the seat having a major axis extending from side to side of the seat, and means for shifting the attitude of the seat relative to the support means between a generally upright position and a reclining position, comprising pivot means interconnecting the seat bottom and the support means and providing a pivotal axis for the support means relative to the seat bottom, which is parallel to and radially displaced from the major axis of the support means.

In accordance with another aspect of the present invention there is provided a reclining chair comprising a seat having a back, sides and a rigid bottom, means for supporting the seat comprising an elongated rigid member disposed across the bottom of the seat and extending from side to side of the seat, means for shifting the attitude of the seat relative to the support means between a generally upright position and a reclining position, comprising pivot means secured to the elongated rigid member, providing a pivotal axis parallel to and radially displaced from the major axis of the elongated member, and means mounting the pivot means on the seat bottom for pivotal rotation of the pivot means and the elongated rigid member about the pivotal axis.

It is therefore an object of the invention to provide an improved reclining chair.

A further object of the invention is to provide a reclining chair having a seat which can be shifted in attitude between a generally upright position and a reclining position.

A further object of the invention is to provide a reclining chair of the type described which is supported from the seat bottom.

These and other objects of the invention will become apparent from the following detailed description there of which, when taken in conjunction with the accompanying drawings, describes the best mode presently contemplated for practicing the invention.

DETAILED DESCRIPTION OF THE INVENTION

Figure 1:
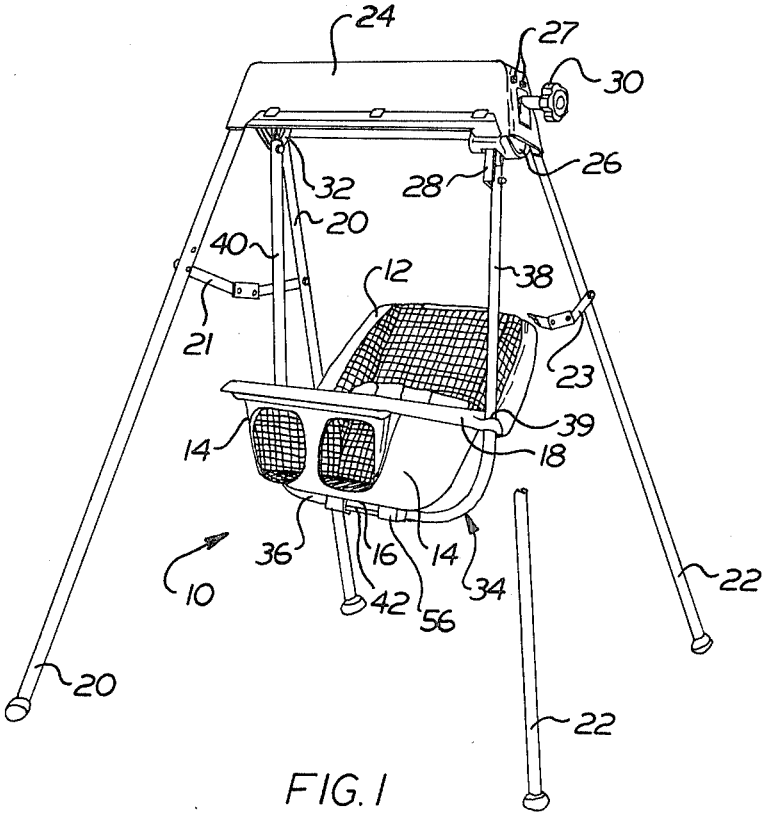
FIG. 1 is a schematic, pictorial view with parts cut away for clarity, of a reclining chair of the present invention.

Referring to FIG. 1, it will be seen that the reclining chair of the present invention, in its preferred embodiment, comprises a seat designated generally as 10, formed preferably of a rigid one-piece plastic molding, having integral back 12, sides 14, bottom 16 and arms 18 having openings 39. It will become apparent from the ensuing discussion that the invention may be practiced with seats having different constructions provided the seat bottom or a portion of it is rigid.

Support means for seat 10 comprise a frame structure which includes legs 20, interconnected by foldable arm 21, legs 22 interconnected by foldable arm 23, and a header 24 to which the upper ends of the legs are fastened. In the illustration, it can be seen that the upper ends of legs 22 are connected to header 24 by means of fasteners 27. Similar fasteners not illustrated connect the upper ends of legs 20 to header 24.

Housed within header 24 is spring motor 26 having output shaft 28 capable of describing oscillatory motion and handle 34 for winding the spring motor. From the lefthand end of header 24, as viewed in FIG. 1, bracket 32 depends, for a purpose which will be described presently.

Support means for seat 10 further comprises an elongated, rigid U-shaped member designated generally as 34, which in the preferred embodiment illustrated takes the form of a hollow tube of generally circular configuration. U-shaped member 34 comprises laterally extending portion 36 having a major axis extending from side to side of the seat, and upwardly extending portions 38, 40 which are connected respectively to output shaft 28 of spring motor 26, and bracket 32. Upwardly extending portion 38 of U-shaped member 34 is fixedly connected to output shaft 28, while upwardly extending portion 40 is connected for relative movement to bracket 32. It will be appreciated that, without departing from the scope of the present invention, spring motor 26 and its output shaft 28 may be replaced by a bracket similar to illustrated bracket 32, to provide a reclining chair structure which is capable of undergoing swinging movement upon the application of manual forces rather than one whose movement is generated by the controlled unwinding of the spring motor.

Figure 2:
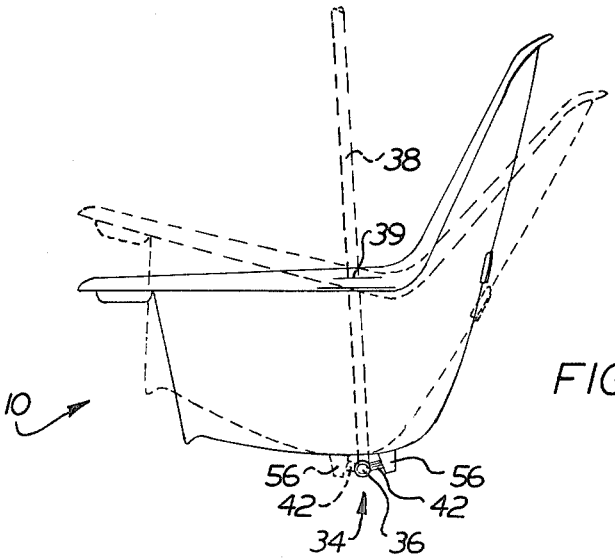
FIG. 2 is a schematic, fragmentary, side elevation with parts in phantom lines, showing the reclining and upright positions of the seat position of the chair illustrated in FIG. 1.

As best illustrated in FIG. 2, seat 10 is capable of undergoing a shift in attitude between a generally upright position, illustrated in full lines, and a reclining position, illustrated in phantom lines. This is accomplished by providing pivot means interconnecting the seat bottom with the seat support means, and providing a pivotal axis for the support means relative to the seat bottom which is parallel to and radially displaced from a major axis of the seat support means.

Figure 3:
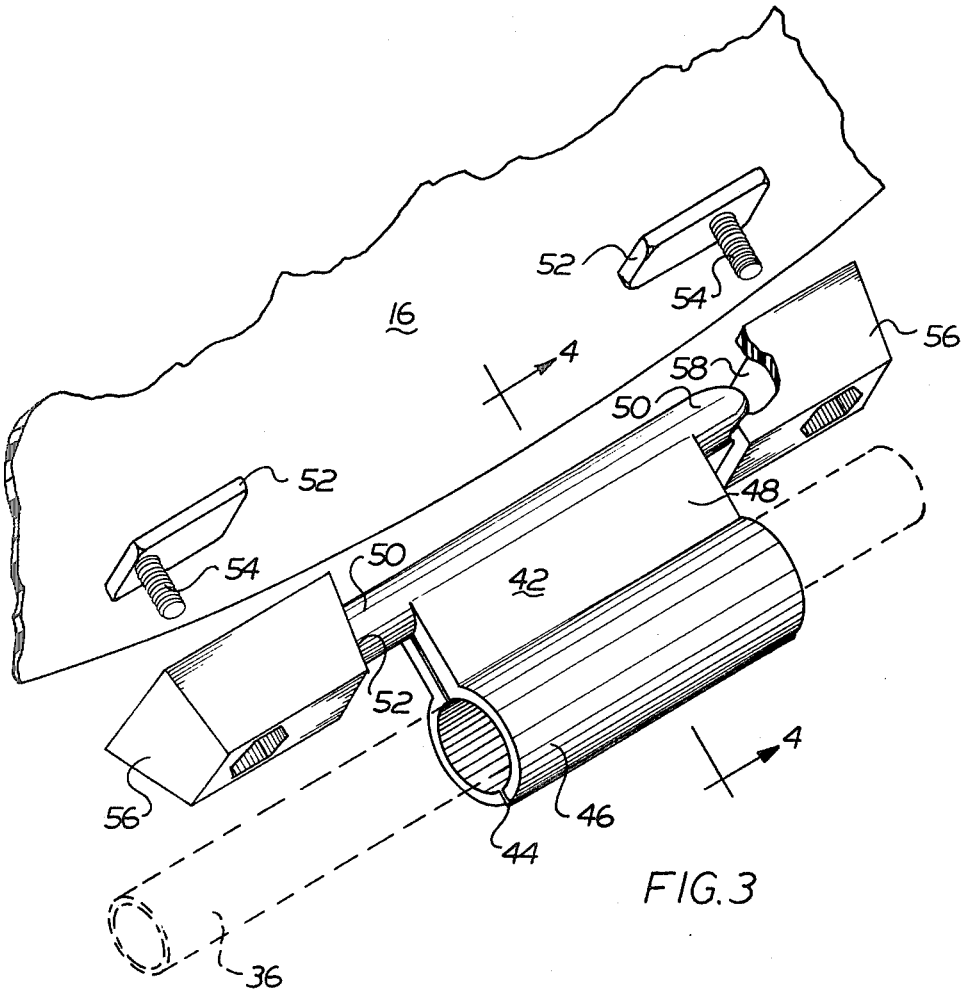
FIG. 3 is a schematic, fragmentary, pictorial, detail view of the structure for pivoting the seat portion of the reclining chair.
Figure 4:
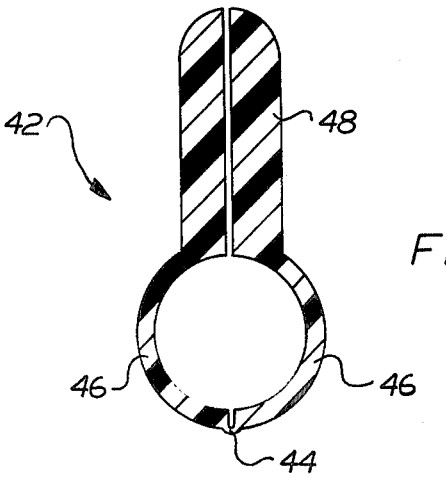
FIG. 4 is a schematic sectional view taken along the line of 4—4 of FIG. 3.

A preferred embodiment of such pivot means is illustrated in FIGS. 3 and 4 and takes the form of pivot member 42 which is a plastic member folded at integral hinge 44, and comprised of opposed semicircular portions 46, web portions 48 and pin portions 50.

As best illustrated in FIG. 3, the outside surface of bottom 16 of seat 10 is provided with locator pads 52 and bolts 54, which are adapted respectively to locate and secure pivot blocks 56 to the seat bottom. Each pivot block 56 is provided with aperture 58 which is adapted to receive pin portion 50 of pivot member 42.

With pivot blocks 56 secured to seat bottom 16, pin portions 50 disposed for pivotal rotation within apertures 58 in pivot block 56, and semicircular portions 46 of pivot member 42 telescopically engaging a section of laterally extending portion 36 of U-shaped member 34, it is then possible to shift the attitude of seat 10 relative to U-shaped member 34 between a generally upright position and a reclining position. The shifting action is accomplished as follows:

With reference to FIG. 2, and particularly to that portion of the drawing shown in full lines, with pivot member 42 rotated clockwise (as viewed in the drawing) about an axis defined by a line through pin portions 50, laterally extending portion 36 of U-shaped member 34 is disposed forwardly of pivot blocks 56 as illustrated in full lines in FIG. 2. This causes the seat to assume a generally upright position, also as illustrated in full lines in FIG. 2.

By grasping semicircular positions 46 of pivot member 42 and rotating the pivot member counterclockwise about the axis defined by a line through pin portions 50, laterally extending portion 36 of U-shaped member 34 is moved rearwardly of pivot blocks 56, a relationship illustrated in phantom lines in FIG. 2. This causes seat 10 to shift to the reclining position, also illustrated in phantom lines in FIG. 2.

Seat 10 may be returned to its upright position by reversing the above-described action and rotating pivot member 42 about the axis defined by a line through pin portions 50 in a clockwise direction, moving semicircular portions 46 of pivot member 42 with the telescopically engaged laterally extending portion 36 of U-shaped member 34, forwardly with respect to pivot blocks 56.

It will be appreciated that openings 39 in arms 18 are sufficiently large to accommodate upwardly extending portions 38, 40 of U-shaped member 34 when seat 10 is disposed in its upright and reclining positions.

Having thus described my invention, I claim:

1. A reclining chair comprising a molded seat having an integral back, sides, bottom, and arms, each of the arms having an opening therein, support means for said seat having a major axis extending from side to side of the seat, and means for shifting the attitude of the seat relative to the support means, between a generally upright position and a reclining position, comprising pivot means interconnecting the seat bottom and said support means and providing a pivotal axis for said support means relative to the seat bottom which is parallel to and radially displaced from the major axis of said support means, said support means comprising an elongated rigid member and said pivot means comprising means engaging said elongated rigid member and the seat bottom intermediate the sides of the seat, said elongated rigid member is generally U-shaped, having a portion extending across the bottom of the seat, and portions extending upwardly along the sides and through the openings in the arms of the seat.

2. The reclining chair defined in claim 1 wherein said support means further comprises a frame, and means connecting the upwardly extending portions of said elongated rigid member to said frame.

3. The reclining chair defined in claim 2 wherein said means connecting the elongated rigid member to said frame includes means for effecting oscillatory movement of said elongated rigid member and supported seat with respect to said frame.

4. A reclining chair comprising a seat having a back, sides and a rigid bottom, each having inner and outer surfaces, means supporting said seat comprising an elongated rigid member disposed across the outer surface of the bottom of the seat and extending from side to side of the seat, said elongated rigid member being U-shaped and having portions extending upwardly, along the outer surfaces of the sides of the seat, means for shifting the attitude of the seat relative to the support means, between a generally upright position and a reclining position, comprising pivot means secured to said elongated rigid member, providing a pivotal axis parallel to and radially displaced from the major axis of said elongated member, and means mounting said pivot means on the outer surface of said seat bottom for pivotal rotation of said pivot means and said elongated rigid member about said pivot axis.

5. The reclining chair defined in claim 4 wherein said pivot means comprises pins extending parallel to and radially displaced from the major axis of said elongated rigid member and the means mounting said pivot means on the outer surface of said seat bottom comprises blocks secured to said seat bottom having apertures adapted to receive said pivot pins.

6. The reclining chair defined in claim 4 wherein the means supporting said seat further comprises a frame and means connecting the upwardly extending portions of said elongated rigid member to said frame.

7. The reclining chair defined in claim 6 wherein said means connecting the elongated rigid member to said frame includes means for effecting oscillatory movement of said elongated rigid member and supported seat with respect to said frame.

8. A swing assembly for supporting a person for swinging movement, said swing assembly comprising a base, seat means for receiving a person, said seat means having a rigid bottom, a rigid support pivotally connected with said base and said seat means, said support having a first portion disposed beneath the rigid bottom of said seat means, a second portion extending upwardly along one side of said seat means and a third portion extending upwardly along a side of said seat means opposite from said one side, first connection means for connecting said first portion of said support with said rigid bottom of said seat means and for shifting the rigid bottom of said seat means relative to said support to change the angular orientation of the rigid bottom of said seat means relative to said support and said base, second connection means for connecting said second portion of said support with said seat means and for enabling the angular orientation of the rigid bottom of said seat means to be changed relative to said second portion of said support, and third connection means for connecting said third portion of said support with said seat means and for enabling the angular orientation of the rigid bottom of said seat means to be changed relative to said third portion of said support, said second and third connection means including means for cooperating with said support and said first connection means to hold said rigid bottom of said seat means in any one of a plurality of angular orientations relative to said support during swinging movement of said seat means relative to said base.

9. A swing assembly as set forth in claim 8 wherein said first connection means includes a member pivotally connected with a lower side of said rigid bottom of said seat means and with said first portion of said support, said member being pivotal relative to said rigid bottom of said seat means to change the position of said first portion of said support from a first position to a second position.

* * * * *